US007652206B2

(12) United States Patent
Okamoto

(10) Patent No.: US 7,652,206 B2
(45) Date of Patent: Jan. 26, 2010

(54) DRUM AND MANUFACTURING METHOD OF CYLINDER THEREOF

(75) Inventor: Shigehiro Okamoto, Hamamatsu (JP)

(73) Assignee: Yamaha Corporation, Shizuoka-ken (JP)

( * ) Notice: Subject to any disclaimer, the term of this patent is extended or adjusted under 35 U.S.C. 154(b) by 0 days.

(21) Appl. No.: 12/046,003

(22) Filed: Mar. 11, 2008

(65) Prior Publication Data

US 2008/0223194 A1 Sep. 18, 2008

(30) Foreign Application Priority Data

Mar. 13, 2007 (JP) ..... 2007-063747

(51) Int. Cl.
*G10D 13/02* (2006.01)

(52) U.S. Cl. ..... 84/411 R

(58) Field of Classification Search ..... 84/411 R; 217/96, 78, 72

See application file for complete search history.

(56) References Cited

U.S. PATENT DOCUMENTS

| | | | | | |
|---|---|---|---|---|---|
| 160,664 | A | * | 3/1875 | Kelly | 217/72 |
| 222,987 | A | * | 12/1879 | Donald | 217/96 |
| 459,646 | A | * | 9/1891 | Pleukharp | 217/88 |
| 700,567 | A | * | 5/1902 | Schwab | 217/96 |
| 885,371 | A | * | 4/1908 | Petracchi | 52/99 |
| 1,381,494 | A | * | 6/1921 | Olsen | 84/411 R |
| 2,050,461 | A | * | 8/1936 | Perry | 217/72 |
| 2,499,959 | A | * | 3/1950 | Kruse et al. | 144/256.3 |
| 2,538,682 | A | * | 1/1951 | Gramelspacher | 217/72 |
| 2,951,779 | A | * | 9/1960 | Mackey et al. | 217/17 |
| 2,982,435 | A | * | 5/1961 | Moseley | 217/44 |
| 2,987,210 | A | * | 6/1961 | McConnell | 217/44 |
| 3,526,333 | A | * | 9/1970 | Formo, Jr. et al. | 217/44 |
| 3,643,710 | A | * | 2/1972 | Fitzgibbon | 144/4.2 |
| 4,522,006 | A | * | 6/1985 | Plikuhn | 52/585.1 |

(Continued)

FOREIGN PATENT DOCUMENTS

JP 47-12956 4/1972

(Continued)

OTHER PUBLICATIONS

Cooper or Barrel maker, history and lore of barrel making, viewed Feb. 25, 2009 at www.rootsweb.ancestry.com/flbbm/heritage/cooper/barrelmaking.htm.*

(Continued)

*Primary Examiner*—Jeffrey Donels
*Assistant Examiner*—Robert W Horn
(74) *Attorney, Agent, or Firm*—Dickstein Shapiro LLP

(57) ABSTRACT

A cylinder of a drum is produced using a plurality of laminated woods, each of which is formed using a plurality of thin wooden boards, which have grains aligned in the longitudinal direction thereof and which are joined together in the width direction. The laminated woods having rectangular shapes in plan view are reshaped by slantingly cutting out the opposite end portions lying in the width direction along their longitudinal directions. A plurality of reshaped laminated woods are joined together in the width direction so as to form a polygonal cylinder (e.g., a fourteen-sided polygonal cylinder). Then, the exterior and the interior of the polygonal cylinder are subjected to cutting work in a concentric manner in view of different radii, thus completely forming the cylinder having a circular cylindrical shape.

6 Claims, 8 Drawing Sheets

U.S. PATENT DOCUMENTS

| | | | | | |
|---|---|---|---|---|---|
| 5,170,000 | A | * | 12/1992 | Hayashida et al. | 84/192 |
| 5,301,591 | A | * | 4/1994 | Greenberg | 84/411 R |
| 5,353,674 | A | * | 10/1994 | Volpp | 84/411 R |
| 5,981,858 | A | * | 11/1999 | Jeng | 84/411 R |
| 5,987,845 | A | * | 11/1999 | Laronde | 52/845 |
| 6,051,764 | A | * | 4/2000 | Sakurai | 84/291 |
| 6,441,285 | B1 | * | 8/2002 | Kurosaki | 84/411 R |
| 7,446,250 | B1 | * | 11/2008 | van der Meulen | 84/411 R |
| 2007/0295188 | A1 | * | 12/2007 | Lu | 84/411 R |
| 2008/0223194 | A1 | * | 9/2008 | Okamoto | 84/411 R |

FOREIGN PATENT DOCUMENTS

| | | |
|---|---|---|
| JP | 53-47939 | 11/1978 |
| JP | 60-191092 | 12/1985 |
| JP | 03-024595 | 2/1991 |
| JP | 11-045087 | 2/1999 |
| JP | 11-242478 | 9/1999 |
| JP | 3324577 | 3/2001 |
| JP | 3097219 | 8/2003 |
| JP | 2003-316349 | 11/2003 |

OTHER PUBLICATIONS

Artisan Drumworks, Stave Drums © 2009, viewed Feb. 27, 2009 at www.artisandrumworks.com/why-stave/.*

Making a Taiko From a Wine Barrel, viewed Feb. 27, 2009 at users.lmi.net/taikousa/Taiko_body.html.*

The Stave Shell Advantage, Unix Drums, © 2007, viewed Feb. 27, 2009 at www.unixdrums.com/index1.htm.*

* cited by examiner

DRUM AND MANUFACTURING METHOD OF CYLINDER THEREOF

BACKGROUND OF THE INVENTION

1. Field of the Invention

The present invention relates to drums such as bass drums, snare drums, and marching drums. The present invention also relates to manufacturing methods of cylinders used for drums.

The present application claims priority on Japanese Patent Application No. 2007-63747, the content of which is incorporated herein by reference.

2. Description of the Related Art

Generally, cylinders of drums (or drum shells) having openings, across which drumheads are stretched under tension, are manufactured using wooden materials, metals such as aluminum, and other materials such as fiber-reinforced plastics (FRP). For example, wooden materials having adequate hardness and superior acoustic characteristics such as maple, birch, beech, and bamboo have been used for manufacturing cylinders of drums. Drums whose cylinders are composed of metals and synthetic resins cannot produce warm sounds; hence, wooden materials are mainly used as dominant materials for use in the manufacturing of cylinders of drums.

Conventionally-known examples of drums have been disclosed in various documents, namely, Patent documents 1 to 4 as follows:

Patent document 1: Japanese Unexamined Patent Application Publication No. 2003-316349.

Patent document 2: Japanese Unexamined Patent Application Publication No. H11-45087.

Patent document 3: Japanese Patent No. 3324577.

Patent document 4: Japanese Examined Utility Model Application Publication No. S53-47939.

Patent document 1 teaches the laminated structure of a drum shell in which a first sheet material having elasticity is adhered to a second sheet material via the adhesive. As the first sheet material, it is preferable to use synthetic composite materials such as polyester films or similar materials. As the second sheet material, it is preferable to use hard phenol resins, epoxy-base resin fibers, boards, and woods.

Patent document 2 teaches a drum whose cylinder is formed in a polygonal prism composed of a wooden material or a non-wooden material. As the wooden material, it is possible to use particle boards, fiber boards, laminated lumbers, laminated woods, plywood, and the like. As the non-wooden material, it is possible to use synthetic resins, glass fibers, carbon fibers, and boron fibers as well as composite materials selectively using them, and the like.

Patent document 3 teaches a drum whose cylinder is formed using a butt board composed of a plurality of thin flat bamboo members whose surfaces and backsides are alternately joined together in width directions. A plurality of butt boards are laminated together to form a plurality of plywood, which are then joined together in width directions, thus forming the cylinder of a drum.

Patent document 4 teaches that elongated thin wooden boards are joined together in a cylindrical shape so as to form a cylinder of a drum.

The drums disclosed in Patent documents 1 to 4 have merits and demerits, so that they have room for further improvements. Specifically, in the drum shell disclosed in Patent document 1, the sheet materials are mainly composed of plastics, which, unlike wooden cylinders, make it very difficult to produce warm sounds. Compared with wooden cylinders, this type of drum cylinder has a low rigidity and is thus elastically deformable due to the tension of a drumhead or snappy members; this may result in poor tuning.

The cylinder of a drum disclosed in Patent document 2 is shaped in a polygonal prism and is composed of a plurality of boards, which are joined together in width directions. This makes it very difficult for the external peripheral portion of a drumhead to be bent along the opening edge of a cylinder; hence, it is necessary to use a special structure for stretching the drumhead. In other words, generally-known head frames (or hoops) are not adaptable to this type of drum.

The drum disclosed in Patent document 3 needs numerous steps for manufacturing bamboo plywood, which thus raises the manufacturing cost.

The cylinder of a drum disclosed in Patent document 4 is formed using elongated thin wooden boards, which are easily deformable due to drying and age degradation, whereby gaps may be easily formed between the elongated thin wooden boards. For this reason, a tightening member such as a belt is wound around the exterior circumference of a cylinder, wherein screws are inserted into holes formed in the cylinder such that the distal ends thereof are connected to the tightening member via nuts, which are appropriately adjusted so as to apply tension to the tightening member. This increases the number of parts and the number of steps in manufacturing, thus increasing the manufacturing cost. It may be possible to reduce the number of elongated thin wooden boards by enlarging their widths; however, it is very difficult to select wooden materials having regular grain in view. This reduces yields in manufacturing and further increases manufacturing costs.

SUMMARY OF THE INVENTION

It is an object of the present invention to provide a drum whose cylinder is composed of wooden materials easily procured and manufactured with a relatively low cost.

It is another object of the present invention to provide a manufacturing method of the cylinder of a drum.

In a first aspect of the present invention, a drum includes a cylinder and a drumhead, which is stretched across the opening of the cylinder, wherein a plurality of thin wooden boards having grains aligned in the longitudinal directions thereof are joined together in the width direction so as to form a laminated wood; the laminated wood is reshaped by slantingly cutting out opposite end portions in the longitudinal direction thereof so as to form a reshaped laminated wood having a trapezoidal shape in plan view; then, a plurality of reshaped laminated woods are joined together in the width direction so as to form the cylinder.

In the above, the thin wooden board has grains aligned perpendicular to the width direction. Alternatively, the thin wooden board has grains aligned in parallel with the width direction. In addition, a plurality of reshaped laminated woods are joined together so as to form a polygonal cylinder, which is then subjected to cutting work in a concentric manner, thus forming the cylinder having a circular cylindrical shape. The thin wooden board can be composed of a bamboo material.

In a second aspect of the present invention, the cylinder of a drum is manufactured in such a way that a plurality of thin wooden boards having grains aligned in the longitudinal directions thereof are formed; a plurality of laminated woods, each of which is composed of plural thin wooden boards joined together in the width direction are formed; the laminated woods are reshaped by slantingly cutting out opposite end portions thereof in the longitudinal directions, thus forming a plurality of reshaped laminated woods, each of which has a trapezoidal shape in plan view; a polygonal cylinder is formed by combining the reshaped laminated woods joined together in the width direction; then, the exterior and the interior of the polygonal cylinder is subjected to cutting work in a concentric manner, thus forming the cylinder having a circular cylindrical shape.

As described above, the present invention has the following effects.

(1) The cylinder of a drum is produced using the laminated woods, each of which is composed of the thin wooden boards, wherein when the thin wooden boards are each reduced in width, it is possible to reduce the limitation regarding the convention of grains and knots; it is possible to increase the degree of freedom regarding the selection of wooden materials; and it is possible to effectively reuse timber tips. Therefore, it is possible to reduce the material cost, and it is possible to produce the cylinder with a relatively low cost.

(2) Since grains of thin wooden boards are aligned in the longitudinal direction, which substantially matches the transmission direction of vibration of the drum, it is possible to produce good acoustic characteristics. The laminated woods are designed to disperse properties of woods causing warping, distortions, and cracks; hence, it is possible to straighten the laminated woods in shape.

(3) When grains of thin wooden boards are aligned perpendicular to the width direction, grains may be beautifully aligned on the exterior surface of the cylinder of a drum in its circumferential direction.

(4) When grains of thin wooden boards are aligned in parallel with the width direction, grains are visually recognized and aligned straightly along joint portions between thin wooden boards adjoined together.

(5) Thin wooden boards can be composed of bamboo materials, which can be procured inexpensively compared with spruce. Fibers may be elongated uniformly in bamboo materials, which thus have a high rigidity. This may avoid the occurrence of warping and cracks due to temperature variations.

(6) According to the manufacturing method of the cylinder of a drum, a plurality of reshaped laminated woods each having a trapezoidal shape in plan view are joined together in the width direction so as to form a polygonal cylinder; then, the exterior and the interior of the polygonal cylinder are subjected to cutting work in a concentric manner. This eliminates the necessity of bending laminated woods in a cylindrical shape; hence, this reduces influences due to residual stress; thus, it is possible to produce the cylinder having good transmission characteristics of vibration in a drum.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENT

The present invention will be described in further detail by way of examples with reference to the accompanying drawings.

Figure 1:
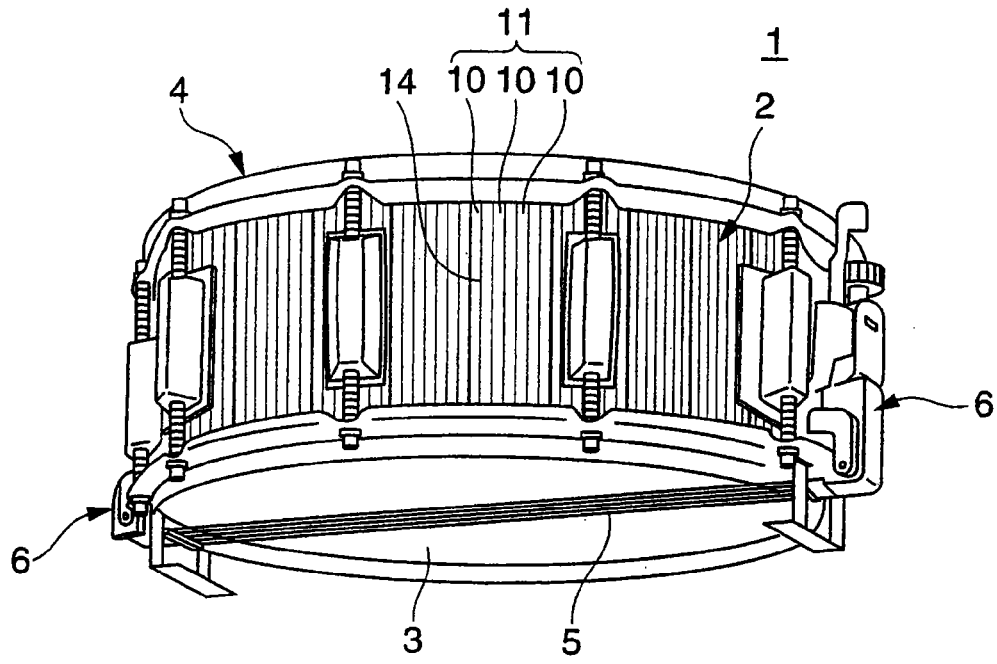
FIG. 1 is a perspective view showing the exterior appearance of a snare drum in accordance with a preferred embodiment of the present invention.
Figure 2:
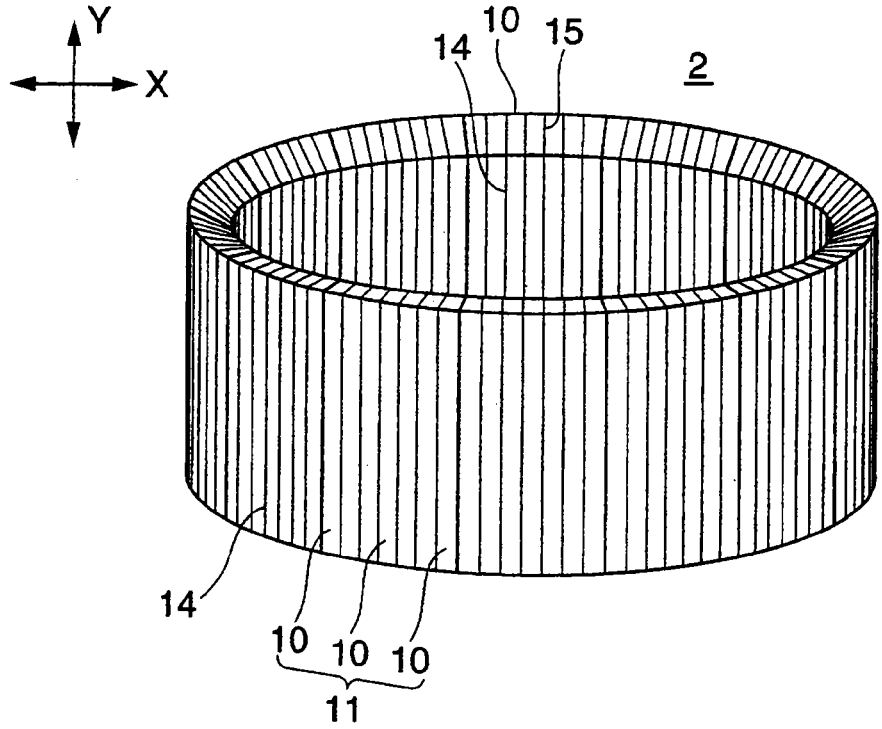
FIG. 2 is a perspective view showing the exterior appearance of a cylinder of the snare drum.

FIG. 1 is a perspective view showing the exterior appearance of a snare drum in accordance with a preferred embodiment of the present invention; and FIG. 2 is a perspective view showing the exterior appearance of a cylinder (i.e., a body) of the snare drum.

A snare drum 1 includes a cylinder 2 having openings at both ends, a drumhead (not shown), which is stretched across the opening of the cylinder 2 in its striking side, a drumhead 3, which is stretched across the opening of the cylinder 2 in its backside, a head support tension device 4 for supporting the drumheads under tension, a plurality of snares 5, which are stretched in connection with the drumhead 3, and a backend mechanism 6.

A plurality of thin wooden boards 10, which are elongated in an axial direction (e.g., a Y-axis direction) of the snare drum 1, are joined together in a width direction (i.e., an X-axis direction) so as to form a laminated wood 11. For example, seven thin wooden boards 10 are joined together to form the laminated wood 11. The cylinder 2 of the snare drum 1 is manufactured using a plurality of laminated woods 11. In the thin wooden board 10, grains 14 are aligned in a longitudinal direction of the thin wooden board 10; in other words, the grains 14 are aligned in the axial direction of the cylinder 2 (i.e., the Y-axis direction). In the thin wooden board 10, the grains 14 appear on a surface 15, which is elongated perpendicular to the width direction of the thin wooden board 10; in other words, the grains 14 are aligned in the width direction. Therefore, the grains 14 of the thin wooden boards 10 are visually aligned in the circumferential direction on the surface of the cylinder 2.

The laminated wood 11 is formed by laminating the prescribed number of thin wooden boards 10 having rectangular shapes; hence, as a whole, it has a rectangular-plate-like shape just after manufacturing. In order to produce the cylinder 2 having a cylindrical shape, it is necessary to further process the laminated wood 11 so as to form reshaped laminated woods having prescribed shapes for use in manufacturing of the cylinder 2. The reshaped laminated woods are joined together in the width direction so as to form a polygonal cylinder having a polygonal shape in plan view, which is then further processed into a circular shape, thus forming the cylinder 2.

Figure 3:
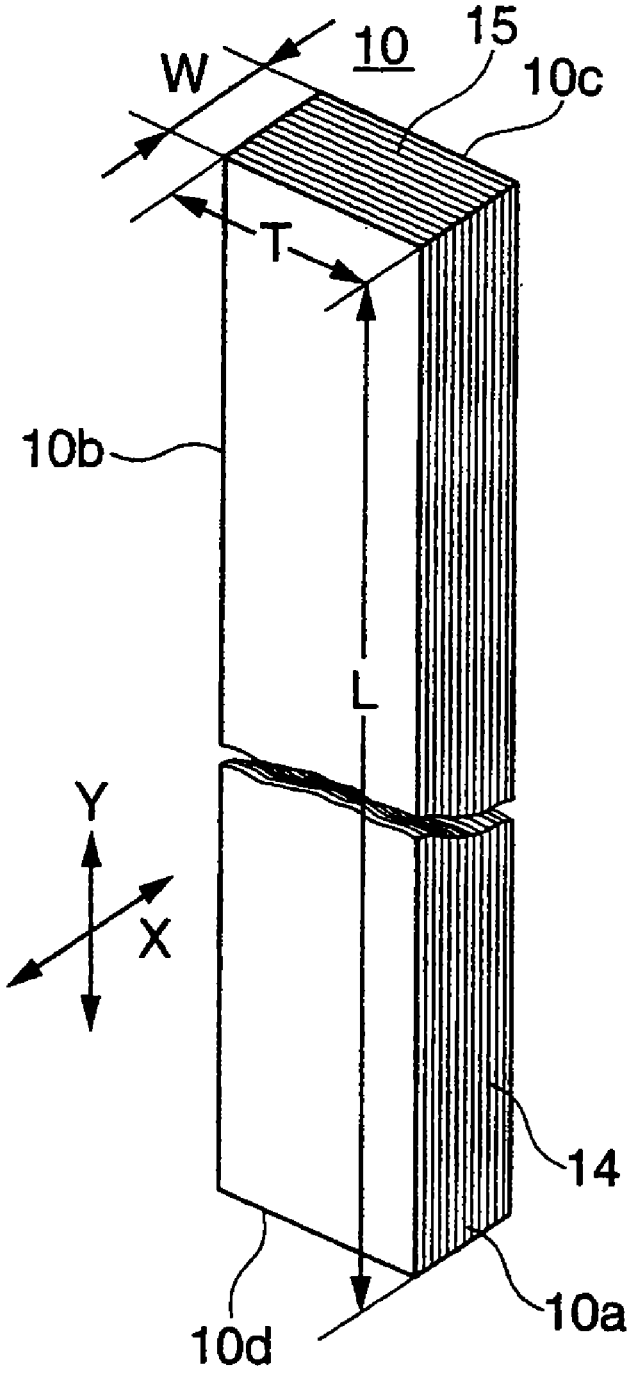
FIG. 3 is a perspective view fragmentarily broken showing a thin wooden board for use in the manufacturing of the cylinder of the snare drum.
Figure 4:
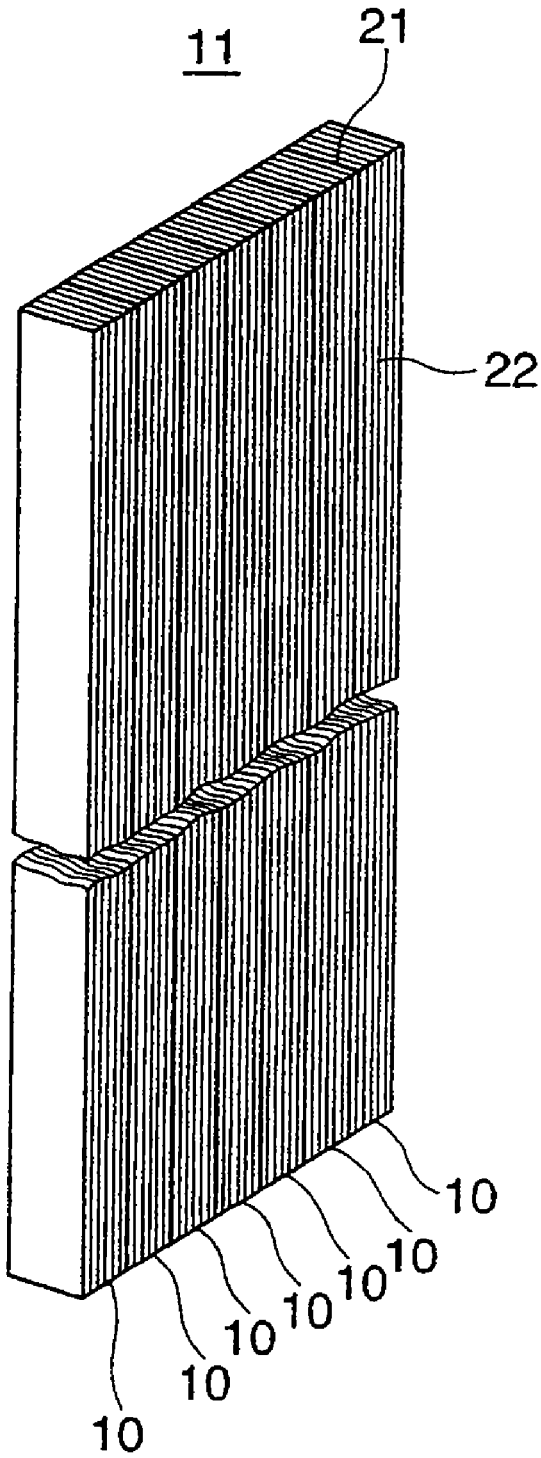
FIG. 4 is a perspective view partly fragmentarily broken showing a laminated wood, which is formed by laminating a plurality of thin wooden boards.
Figure 5A:
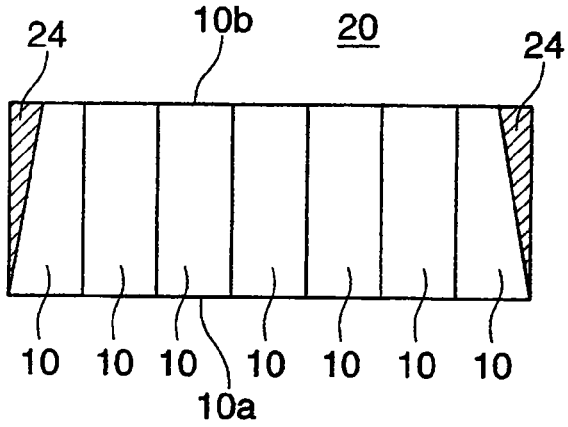
FIG. 5A is a plan view showing a reshaped laminated wood, which is formed by reshaping the laminated wood, for use in manufacturing of the cylinder of the snare drum.
Figure 5B:
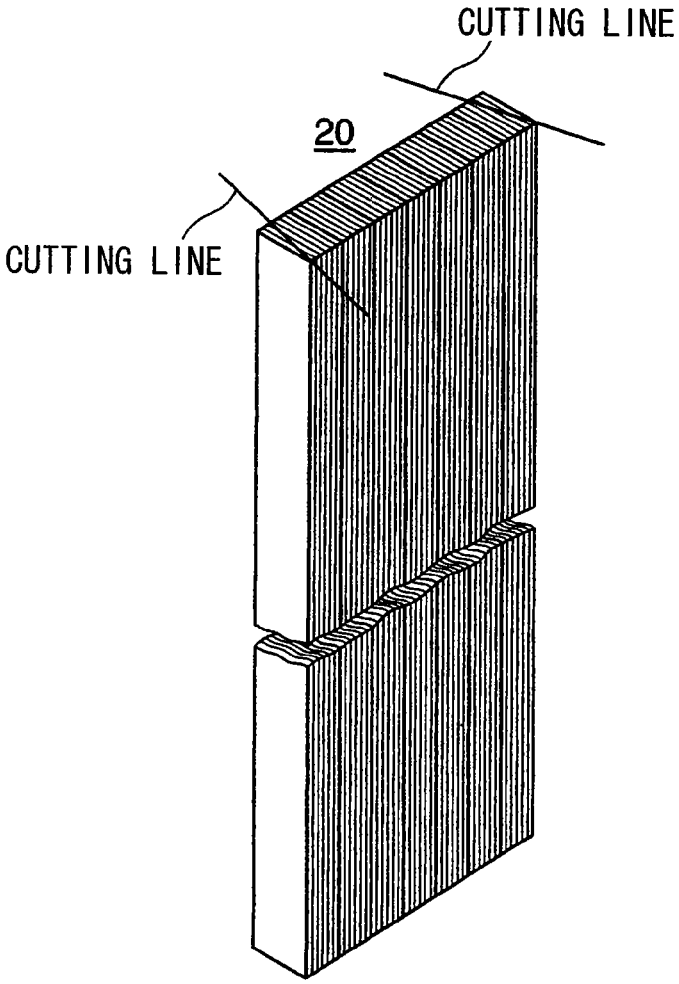
FIG. 5B is a perspective view fragmentarily broken showing the reshaped laminated wood.
Figure 6:
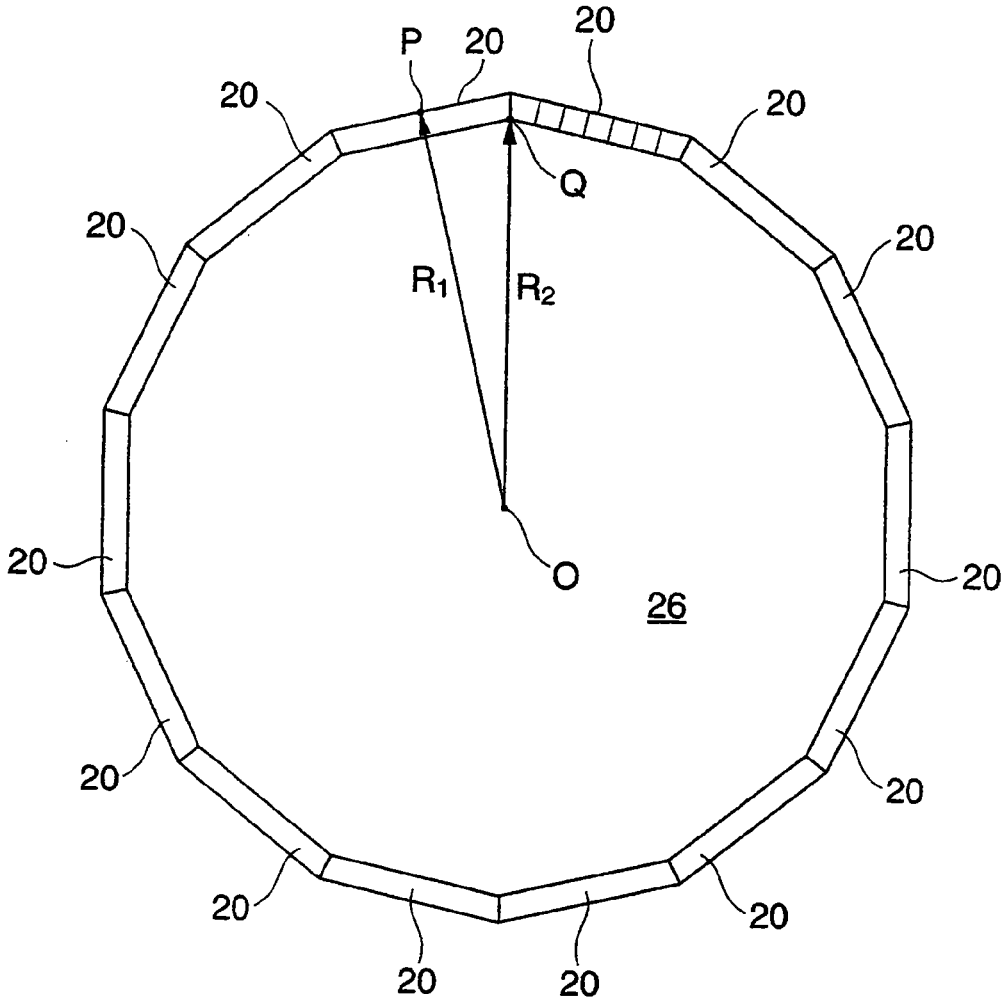
FIG. 6 is a plan view showing a polygonal cylinder that is formed by plural reshaped laminated woods joined together in a fourteen-sided polygon.

Next, a manufacturing method of the cylinder 2 will be described with reference to FIGS. 3, 4, 5A, 5B, and 6. FIG. 3 is a perspective view fragmentarily broken showing the thin wooden board 10; FIG. 4 is a perspective view fragmentarily broken showing the laminated wood 11, which is formed by plural thin wooden boards 10 joined together in the width direction; FIG. 5A is a plan view showing a reshaped laminated wood, which is formed by reshaping the laminated wood 11; FIG. 5B is a perspective view fragmentarily broken showing the reshaped laminated wood; and FIG. 6 is a plan view showing a polygonal cylinder, which is formed by plural reshaped laminated woods in a fourteen-sided polygon.

In the manufacturing of the cylinder 2 of the snare drum 1, the thin wooden board 10 shown in FIG. 3 is produced in such a way that wooden materials having adequate hardness and superior acoustic characteristics such as maple and birch are shaped to suite the snare drum 1 and are then cut in prescribed dimensions defined by length L, width W, and thickness T. The grains 14 of the thin wooden board 10 are aligned in the longitudinal direction (i.e., the Y-axis direction) thereof. That is, the grains 14 can be visually observed on a surface 10*a*, a backside 10*b*, an upper edge 10*c*, and a lower edge 10*d*. The surfaces 15 of the grains 14 are aligned in the width direction of the thin wooden board 10 (i.e., the X-axis direction). Since the thin wooden board 10 is an elongated board having a small width, the timber tips thereof can be reused in manufacturing.

Next, seven thin wooden boards 10 are joined together to form the laminated wood 11 shown in FIG. 4. Specifically, the laminated wood 11 is manufactured in such a way that the adhesive is applied to the side portions of the seven thin wooden boards 10, which are then sequentially laminated together; then, the adhesive is solidified. In FIG. 4, bold lines designate adhered portions between the thin wooden boards 10, and thin lines designate the grains 14.

Next, a reshaped laminated wood 20 shown in FIG. 5 is formed using the laminated wood 11. Specifically, the reshaped laminated wood 20 is manufactured in such a way that the opposite end portions lying in the width direction of the laminated wood 11 are slantingly cut out in a backward direction with a prescribed cutting angle. The cutting angle depends upon a polygonal shape, which is formed using a plurality of reshaped laminated woods 20; in the present embodiment, the cutting angle is set to 13°. By slantingly cutting out the opposite end portions, the reshaped laminated wood 20 is formed in a trapezoidal shape in plan view, wherein the width measured in the surface 10*a* is larger than the width measured in the backside 10*b*. Hatched portions 24 shown in FIG. 5A designate the opposite end portions being cut out.

Next, fourteen section of the reshaped laminated wood 20 are joined together in the width direction via the adhesive, thus producing a fourteen-sided polygonal cylinder 26 as shown in FIG. 6. The polygonal cylinder 26 is subjected to cutting work in a concentric manner by use of a wood lathe, thus forming the cylinder 2 having a cylindrical shape of uniform thickness. Specifically, the exterior of the polygonal cylinder 26 is subjected to cutting work in view of a radius R1 measured from a center O of the polygonal cylinder 26 to a center position P of the surface 10*a* of the reshaped laminated wood 20. In addition, the interior of the polygonal cylinder 26 is subjected to cutting work in view of a radius R2 measured from the center O of the polygonal cylinder 26 to an edge Q of the backside 10*b* of the reshaped laminated wood 20.

Thereafter, the opposite end portions of the polygonal cylinder 26 already subjected to the aforementioned cutting work are subjected to cutting work inwardly and slantingly in a prescribed angle, thus completely forming the cylinder 2 shown in FIG. 2.

According to the manufacturing method of the cylinder 2, there may be a small limitation regarding the conversion of grains and knots in the manufacturing of the thin wooden boards 10, which are thus increased in the degree of freedom regarding the selection of wooden materials, and in which timber tips can be effectively reused. Since the alignment direction of grains of the thin wooden board 10 matches the transmission direction of vibration in the cylinder 2, it is possible to produce good acoustic characteristics. The laminated wood 11 is designed to disperse properties of wood causing warping, distortions, and cracks, which may occur on the thin wooden boards 10 independently; hence, it is possible to straighten the laminated wood 11 in shape.

In addition, the polygonal cylinder 26 is produced using a plurality of reshaped laminated woods 20, wherein the interior and the exterior of the polygonal cylinder 26 are individually subjected to cutting work so as to form the cylinder 2 having a circular cylindrical shape. This eliminates the necessity of forcedly bending the reshaped laminated woods 20 and bonding them together. Thus, it is possible to produce the cylinder 2 having good transmission characteristics of vibration without being affected by residual stresses thereof.

The present embodiment can be further modified in a variety of ways.

Figure 7:
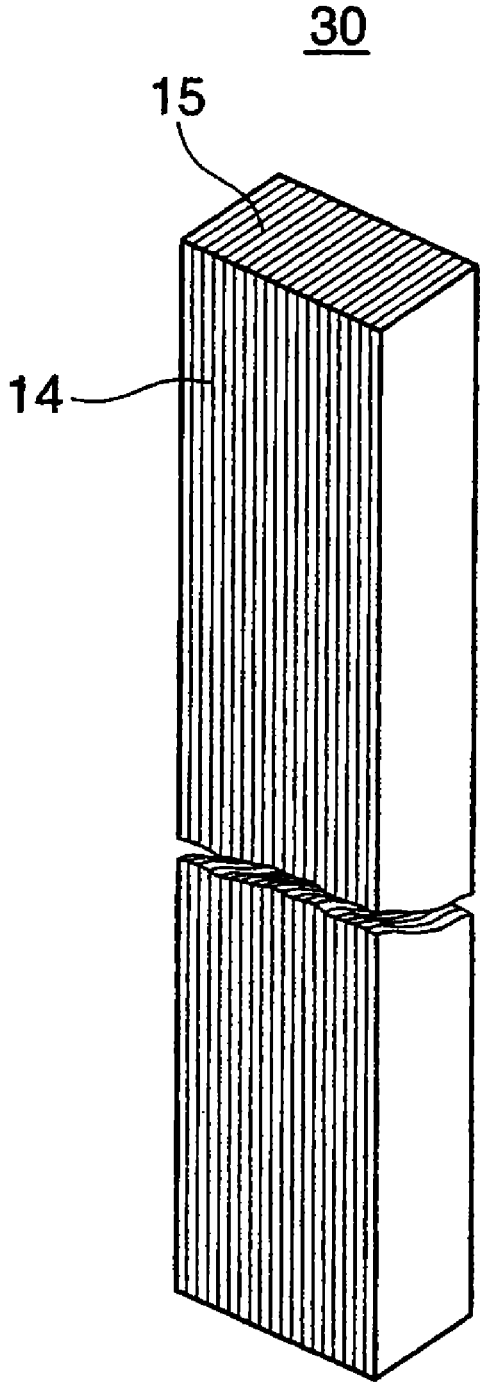
FIG. 7 is a perspective view fragmentarily broken showing a thin wooden board for use in the manufacturing of a cylinder in accordance with a first modified example.
Figure 8:
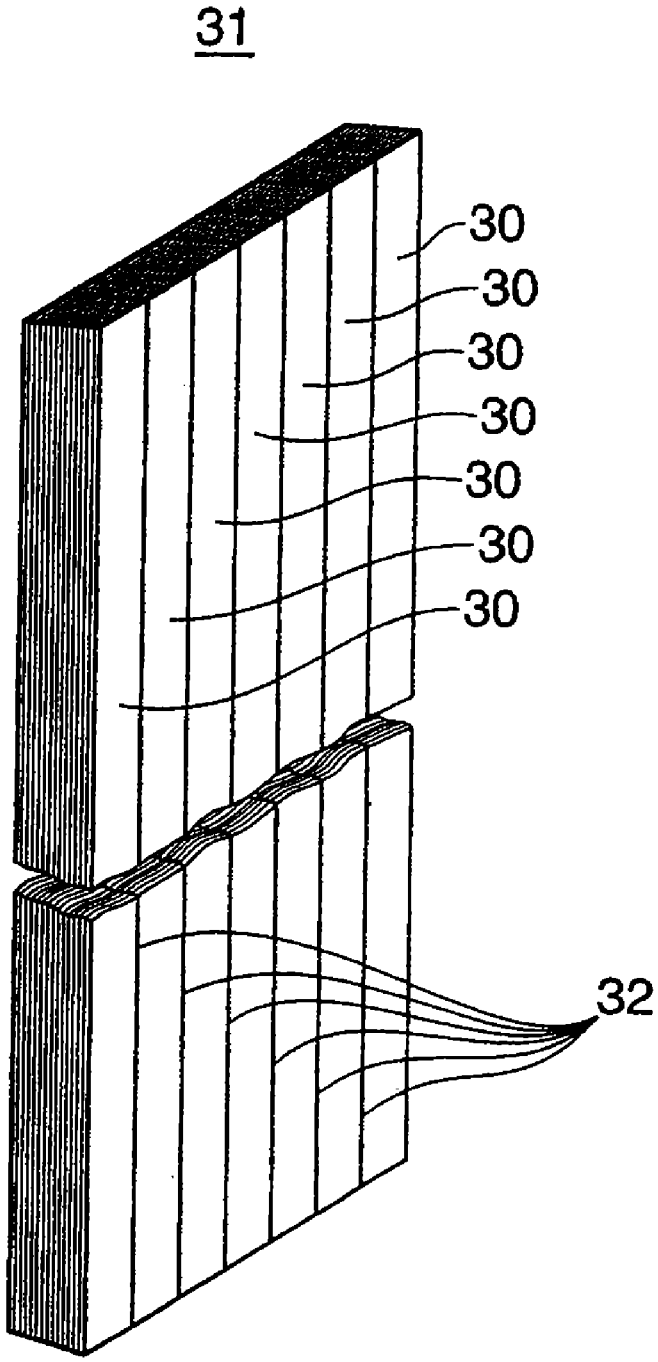
FIG. 8 is a perspective view fragmentarily broken showing a laminated wood, which is produced by a plurality of thin wooden boards joined together, in accordance with the first modified example.

A first modified example will be described with reference to FIGS. 7 and 8, wherein FIG. 7 is a perspective view fragmentarily broken showing a thin wooden board 30, and FIG. 8 is a perspective view fragmentarily broken showing a laminated wood 31. The thin wooden board 30 is produced in such a way that the surfaces 15 having the grains 14 are joined together perpendicular to the thickness direction thereof, and the laminated wood 31 is produced by a prescribed number of the thin wooden boards 30, which are joined together in the width direction thereof.

When the cylinder 2 is produced using a plurality of the laminated woods 31, the grains 14 are not exposed on the exterior surface of the cylinder 2, wherein joint surfaces 32 between the thin wooden boards 30 adjoined together are visually recognized as straight pseudo-grains.

Figure 9:
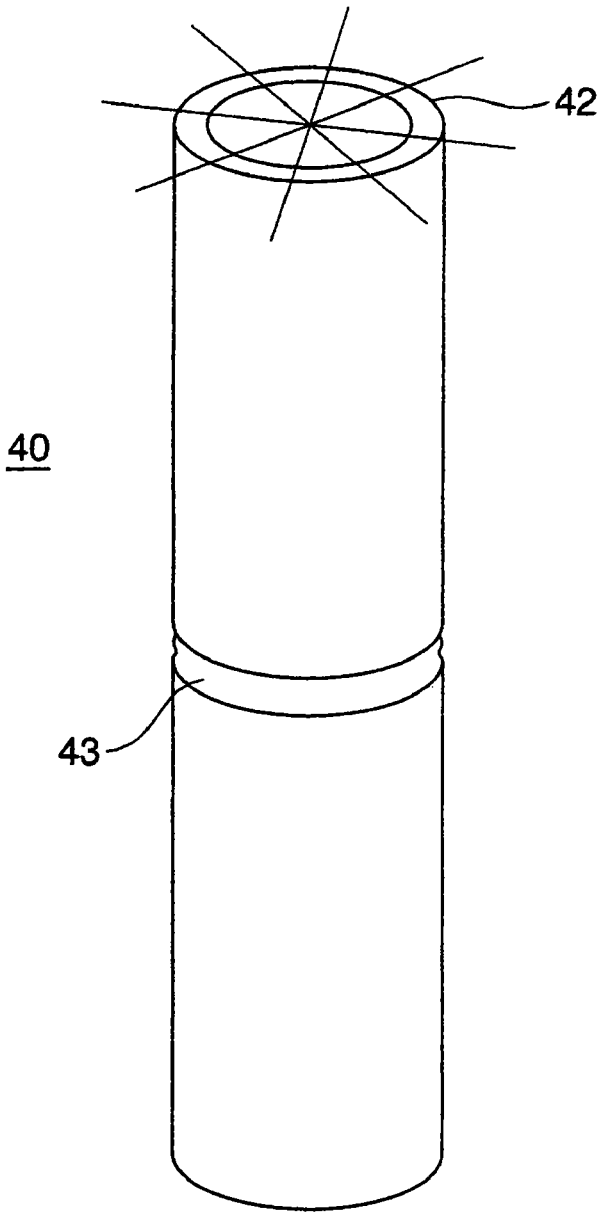
FIG. 9 is a perspective view showing a bamboo material for use in the formation of a thin wooden board in manufacturing of a cylinder of a drum in accordance with a second modified example.
Figure 10:
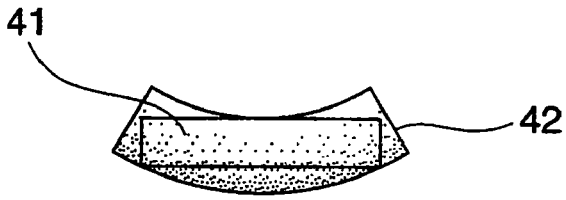
FIG. 10 is a cross-sectional view showing the thin wooden board, which is produced using a bamboo tip split from the bamboo material.

A second modified example will be described with reference to FIGS. 9 and 10, wherein FIG. 9 is a perspective view showing a bamboo material 40 belonging to the rice family, and FIG. 10 is a cross-sectional view showing a thin wooden board 41. The thin wooden board 41 is produced using the bamboo material 40; then, a plurality of the thin wooden boards 41 are joined together in the width direction so as to form a laminated wood; thereafter, a plurality of the laminated woods are joined together so as to form a cylinder for use in a drum.

Specifically, the bamboo material 40 is split into a plurality of bamboo tips 42 each having a circular arc shape; then, the thin wooden board 41 having an elongated thin rectangular shape is formed using the bamboo tip 42.

As the bamboo material 40, it is preferable to use Japanese bamboo (namely, Moso bamboo whose nomenclature is "Phyllostachys *pubescens*); however, it is possible to use imported bamboo, which is produced in Asian countries, African countries, South America, and North America. Bamboo materials include canes and roots, wherein it is preferable to use canes, which are elongated straight with relatively long lengths between knots 43. Specifically, bamboo materials whose ages and colors substantially match each other and which do not have stains, spots, and flaws are carefully selected and are then cut into desired lengths, thus producing the bamboo material 40. Then, the bamboo material 40 is subject to cutting in the circumferential direction and is split into a plurality of bamboo tips 42. The bamboo tip 42 is processed into the thin wooden board 41. When the knot 43 is included in the bamboo material 40, it is further processed in a flat shape.

After completion of the production of the thin wooden board 41 by use of the bamboo material 40, a plurality of thin wooden boards 41 are combined together and are then subjected to cutting work as described before, thus producing a cylinder of a drum. Specifically, a plurality of thin wooden boards 41 are joined together in the width direction so as to form a laminated wood, wherein the surfaces and backsides of the thin wooden boards 41 are joined together alternately so as to make uniform contractions of the surfaces and backsides due to temperature variations, thus avoiding the occurrence of warping and cracks. Next, the laminated woods are reshaped by slantingly cutting out the opposite end portions lying in the longitudinal direction and width direction thereof, thus forming a reshaped laminated wood having a trapezoidal shape in plan view or side view. Next, a plurality of reshaped laminated woods are combined together in the width direction so as to form a polygonal cylinder. Thereafter, the exterior and interior of the polygonal cylinder are subjected to cutting work in a concentric manner, thus forming a cylinder having a circular cylindrical shape of uniform thickness for use in a drum.

When the cylinder of a drum is produced using the thin wooden board 41 composed of the bamboo material 40, it is possible to remarkably reduce the material cost because bamboo is inexpensive compared to precious woods such as maple, beech, and birch. Since bamboo has high rigidity, straightness, and uniform constitution, it is possible to stably produce good acoustic characteristics.

The present embodiment and modified examples are each designed to finally produce cylinders having circular cylindrical shapes; but this is not a restriction; hence, it is possible to realize polygonal cylinders.

Lastly, the present invention is not necessarily limited to the present embodiment and modified examples, which can be further modified in a variety of ways within the scope of the invention as defined in the appended claims.

What is claimed is:

1. A drum formed in the shape of a cylinder, the cylinder having an axial direction, a radial direction and a circumferential direction, the drum comprising:

a plurality of laminated wood units joined together in the circumferential direction of the cylinder, each of the laminated units comprising a plurality of thin wooden boards having grains aligned in the axial direction and having a width in the circumferential direction, the plurality of thin wooden boards being joined together in the width direction so as to form the laminated wood units;

wherein each end board of each of the laminated wood units, which is joined to an end board of an adjacent laminated wood unit, has a trapezoidal shape in the radial direction formed by a cut in the radial direction of end portions of the end boards.

2. The drum according to claim 1, wherein the plurality of thin wooden boards have grains aligned perpendicular to the width radial direction.

3. The drum according to claim 1, wherein the plurality of thin wooden boards have grains aligned in parallel with the radial direction.

4. The drum according to claim 1, wherein an outside surface of the each of plurality of the reshaped laminated wood units have a circular cylindrical shape.

5. The drum according to claim 1, wherein the thin wooden boards are composed of a bamboo material.

6. A method of manufacturing a cylinder of a drum, the cylinder having an axial direction, a radial direction and a circumferential direction, the method comprising:

forming a plurality of thin wooden boards having grains aligned in the axial direction of the cylinder, each of the plurality of wooden boards having a length in the axial direction and a width in the circumferential direction;

forming a plurality of laminated wood units, each of which is composed of the plurality of thin wooden boards joined together in their width direction, the plurality of laminated wood units having two end boards;

reshaping the plurality of laminated wood units by cutting end portions of the end boards along their length in the radial direction thus forming a plurality of reshaped laminated wood units, each of which has a trapezoidal shape in the radial direction;

forming a polygonal cylinder, which is composed of the plurality of reshaped laminated wood units joined together at the end boards; and shaping an exterior and an interior of the polygonal cylinder in a concentric manner, thus forming the cylinder having a circular cylindrical shape.

* * * * *